United States Patent [19]

Hinger

[11] 3,998,123

[45] Dec. 21, 1976

[54] MALLETS FOR PLAYING UPON MUSICAL INSTRUMENTS

[75] Inventor: Fred D. Hinger, Leonia, N.J.

[73] Assignee: Hinger Touch-Tone Corporation, Leonia, N.J.

[22] Filed: Dec. 30, 1974

[21] Appl. No.: 537,484

[52] U.S. Cl. ..... 84/422 S
[51] Int. Cl.[2] ..... G10D 13/00
[58] Field of Search ..... 84/422 R, 422 S

[56] References Cited

UNITED STATES PATENTS

| | | | |
|---|---|---|---|
| 1,739,275 | 12/1929 | Zipperstein | 84/422 S |
| 3,217,581 | 11/1965 | Hinger | 84/422 S |
| 3,665,799 | 5/1972 | Hinger | 84/422 S |

*Primary Examiner*—John Gonzales
*Attorney, Agent, or Firm*—Synnestvedt & Lechner

[57] ABSTRACT

A mallet for playing upon musical instruments comprises a hard shaft with a handle end and a head end, and having a head retainer at the latter end, and additional retaining means inboard thereof, there being a replaceable playing head which is centrally apertured to pass lengthwise onto the shaft, from the handle end to the head end, where it is held against flying off, by means of said retainer, and is held against slipping back over the shaft, by means of said retaining means; the head having at least the central zone, around said aperture, formed to be resiliently yieldable, whereby the head may be forced over or onto the said retaining means.

15 Claims, 9 Drawing Figures

16
18
24
12
19
17
15
H
11
14
G
13

12
16b
17b
H2
11b
28
27
G1
26

18
16
24
19
12
3
3
23
22
21
17
15
20
11

12
16
17a
20
11a 24
22
23
25
21
2
2
12

16b
12
22
24
23
21
8
8
17b
11b 16b
17b
11b 17b
11b 17c
11c
17c

MALLETS FOR PLAYING UPON MUSICAL INSTRUMENTS

This invention relates to MALLETS FOR PLAYING UPON MUSICAL INSTRUMENTS, and especially to mallets having removable and replaceable playing heads, whereby a worn or damaged head may be replaced, or different heads may be alternatively applied so that different playing effects may be obtained and/or so that the mallets may be adapted for playing upon different instruments.

More specifically, the invention relates to such mallets, wherein the shaft is relatively hard and stiff, and the playing head is in whole or in part resiliently yieldable, not only for its playing characteristics but also for purposes of assembly and disassembly of the mallet, or replacement of the head, in a novel manner, as will hereinafter appear; and in these, and other respects, the invention involves improvements over the mallets disclosed in my prior U.S. Pat. No. 3,665,799.

The principal object of the invention is to simplify and otherwise improve the construction of a musical instrument mallet, in such manner as to reduce the cost of producing the mallet, render the mallet more versatile by exceptionally easy replaceability of heads, and also more economical as to maintenance, while at the same time improving the playing characteristics of the mallet and the tonal qualities obtainable from the instrument with which it is used.

How the foregoing and other objects and advantages of the invention may be obtained will be evident from the following description of one or more presently-preferred embodiments of the invention, when taken together with the accompanying drawings.

Figures 1, 2, 3, 4, 5, 6, 7, 8, 9:
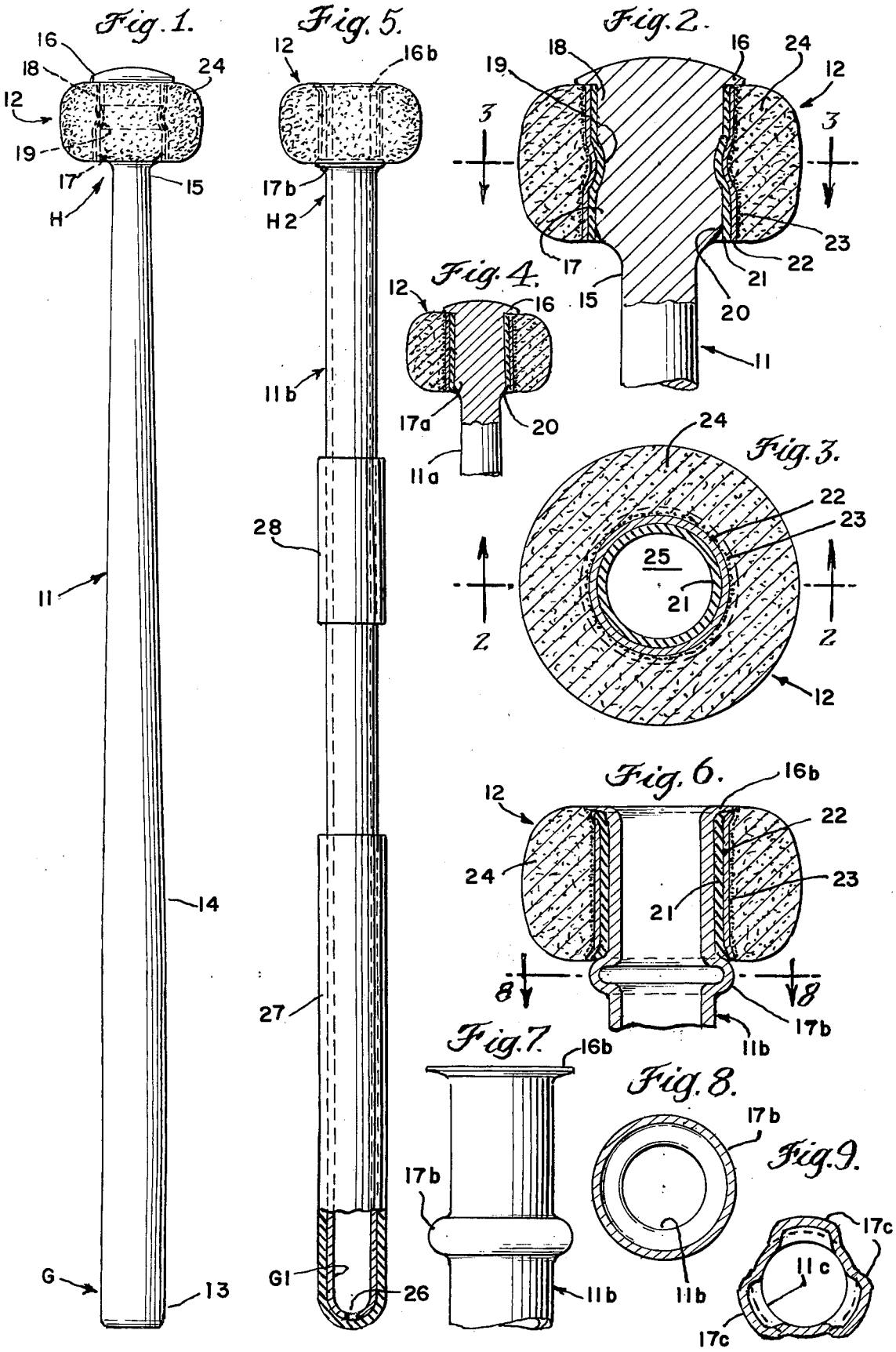
FIG. 1 is an elevational view of a mallet in accordance with the present invention, showing in dotted or phantom outline certain features of the playing head and of its mounting and cooperation with the mallet shaft, which latter in this instance is a wooden shaft.
FIG. 2 is a fragmentary view of the head end of the shaft of FIG. 1, with the playing head thereon, shown in section, to a somewhat larger scale than FIG. 1, and taken on the line 2—2 of FIG. 3.
FIG. 3 is a section of the playing head of the mallet of FIGS. 1 and 2, taken on the line 3—3 of FIG. 2, with the shaft omitted.
FIG. 4 is a view somewhat similar to FIG. 2, substantially on the scale of FIG. 1, but showing a modified construction.
FIG. 5 is a view similar to FIG. 1, but of a second modification, and with a portion of the handle end of the mallet shown in longitudinal section.
FIG. 6 is a view of the head end of the mallet of FIG. 5, taken in a manner similar to the view of FIG. 2.
FIG. 7 is a fragmentary detail of the head end of the shaft of the construction shown in FIG. 6.
FIG. 8 is a sectional detail view on the line 8—8 of FIG. 6.
FIG. 9 is a somewhat similar sectional detail view of a modified form of shaft.

Referring now to FIGS. 1 to 3, it will be seen that the mallet in this form embodies a solid one-piece shaft member 11, which, though it might be made of other materials, such as a hard, stiff plastic, is preferably of wood, and a playing head generally designated 12, the nature and construction of which will be hereinafter set forth in more detail, although the head is in general of larger diameter than the shaft or stick, and at least an inner portion of the head must be made of, or be supplied with, a resiliently yieldable material in a zone which is adapted for cooperation with the shaft.

For purposes of balance, weight, grip, feel, and certain playing characteristics, the shaft 11 is desirably of larger diameter near the grip- or handle-end G than it is near the head-end H; being generally tapered, as shown, so that the smallest diameter is about two-thirds of the largest diameter, although this may be varied a good deal. For convenience of gripping, the maximum diameter may extend, approximately cylindrically, for about one-third of the length of the shaft, i.e. from about the region 13 to the region 14, and tapered down to a minimum at 15.

Between the extreme outer end and the region 15, the shaft has certain features adapted to cooperate with the mallet head 12, and while certain of these features may be made separately, and applied to the shaft, it is preferred that they be formed integrally with the shaft; and, for this purpose, they may be readily formed by turning them on a lathe, along with the turning of the shaft. Thus, at the extreme outer end, the shaft of the mallet is formed with a sort of a button 16, in the form of a rib or shoulder, which serves as a head retainer, to keep the head 12 from being dislodged outwardly off the end of the shaft. Spaced inboard from said retainer is another retaining means, which may take the form of another cylindrical shoulder 17, preferably of slightly larger diameter than the cylindrical portion 18. There may also be an annular groove 19. Either the inner shoulder portion 17 or the grooved portion 19 of the head end of the shaft will tend to hold the head 12 against slipping back on the shaft; and, in the form shown, they both tend to serve this purpose, as will now appear. The turning of the wooden shaft desirably includes also a beveled or rounded peripheral edge at 20, at the inboard extremity of the shoulder 17.

While the head 12 may, for playing on certain types of instruments, be made of a single mass of resiliently yieldable material, for example: the entire playing head may be made of rubber, or any other suitable resiliently yieldable material; it is preferable to use a compound head; and in the present embodiment the head 12 comprises a central tubular sleeve 21, which is desirably of rubber or of other suitable material, such, for example, as neoprene, and on the outside of said sleeve a winding of masking tape 22 or a suitable substitute, and adhesively secured thereon at 23 a main body 24 of felt, which may be integrally formed to the shape of a striking head or may be wrapped upon the assembly, and secured adhesively or by stitching; or may be integrally formed upon the assembly and further secured by a stitched cover (not shown).

With respect to the present invention, it is important that at least the central zone of the head 12, i.e. the zone immediately surrounding the central aperture (generally designated 25), be resiliently yieldable, and that the aperture itself be of such a diameter, that, when the head is slipped onto the shaft at the handle end G, and is moved up to the head end H, there will be a very tight fit of the head with respect to the shoulder 17, so that the playing head must be forced over said shoulder and up against the outer retainer 16; so that the retainer 16 will prevent the head from flying off of the shaft, during normal use of the mallet, and the shoulder 17 will serve as retaining means to prevent the head from sliding back along the shaft during normal playing operation of the mallet.

With the construction shown and described with reference to FIGS. 1 to 3, the entire head is to some extent of a resiliently yieldable nature, and if the head did not involve elements 22, 23 and 24 of a yielding nature, the central tubular sleeve 21 would itself serve the purpose of being resiliently so yieldable as to be forced over the shoulder 17 and be gripped thereon and further gripped outboard thereof, so that the head would be held between the retainer 16 and the shoulder 17.

With reference to the form shown in FIGS. 1 to 3, it will now be clear that the diameter of the central aperture of the head, represented by the internal diameter of the sleeve 21, is such as to slide onto and along the shaft, from the grip end G, to the head end H; and that when the head 12 has been forced up against the retainer 16, it is securely held between that retainer, and the inboard retaining means (whether the latter comprises merely the peripheral enlargement 17, or the groove 19, or both). It will now also be apparent that a worn or damaged head can be very readily removed and replaced, by forcing the old head backwards, over the inboard retaining means, sliding it back along the shaft and pushing it off of the innermost end thereof; and then pushing a new head onto the shaft from the end G, up to the end H, and into place. Likewise, if the mallet is to be used for playing on different instruments, for example: on timpani, marimba, xylophone, gongs, chimes, cymbals, bass drums, or any other percussion instrument, there may readily be a substitution of heads of different sizes, different forms, different materials, and different playing characteristics, so as to obtain different tonal effects.

In actual use, it has been found that the construction shown has the further advantage that with various forms and materials of main head body 24, the resiliently yieldable tubular sleeve 21 produces improved results in the way of the sound obtainable from various instruments, when played upon with these mallets. A change in the mass and balance characteristics of the mallet may also be obtainable by substituting heads of different weights.

Turning now to the embodiment shown in FIG. 4, it will be seen that while the head 12 is the same as shown in the embodiment of FIGS. 1 to 3, the shaft 11a has a modified inboard retaining means 17*a*, in that this retaining means is simply an enlargement of the shaft which is at its maximum immediately adjacent to the annular element 20 and which then tapers progressively as it extends outwardly, until it joins the outboard head retainer 16. In other words, there is a tapering of the shaft body between points 16 and 20, in the same sense as in the tapering of the main body of the shaft 11a, although the angle of these two tapers may be quite different.

In the embodiment shown in FIGS. 5 to 8 the head 12 may be the same as those previously described. The shaft 11*b*, however, is a hollow metal tube having a handle end G1 and a head end H2, which tube may conveniently be drawn, or otherwise formed, to a uniform diameter; although at the inner, or handle grip end it may be swaged or otherwise formed to a rounded contour; and over this end, and covering the small remaining aperture 26, there may be slipped on, a fairly tight-fitting flexible handle grip member 27, of rubber, neoprene, or other suitable material.

At the outermost end, the tubular shaft 11*b*, as best seen in FIGS. 6 and 7, may be swaged or otherwise flared out at 16*b*, to form the end head retainer for the playing head 12. Spaced inboard from said head retainer (a distance approximating the end-wise thickness of the head) is a retaining means 17*b*, in the shape of an annular rib, which may be formed by an internal expanding tool, or by any other suitable metal-working technique.

It will now be obvious that the head 12 can be slipped onto the shaft 11*b* from the inner end, forcibly pushed over the rib 17*b*, and thus held on the shaft between the retaining devices 16*b* and 17*b*.

In this embodiment, if additional mass or if variation in balance, is desired, one or more tight-fitting, but slidable, balance weights, such as the one shown at 28 (in FIG. 5), may be applied — to serve purposes similar to those described in prior U.S. Pat. No. 3,665,799, hereinbefore referred to. Such tubular sleeves 28 may be of material similar to the hand grip member 27 and/or to the innermost sleeve member 21 of the playing head.

It will be obvious that when applying or removing a playing head, it is necessary to push the members 27 and 28 off of the shaft 11*b*, so as to make it possible to push the playing head on or off of the shaft.

In FIG. 9, the innermost retaining means 17*c* takes the form of a group of peripherally spaced apart bumps, or partial ribs, pressed out from the wall of the shaft tube 11*c*.

By way of further explanation of the foregoing, but without any intention to limit the case, excepting as may be clearly required by the prior art and/or by the terms of the claims, it may be pointed out that the shaft construction shown in FIGS. 1 and 2 is desirably of a hard wood, such as hickory, apple, maple or persimmon. Where a tape winding is used between the sleeve 21 of the head and the main body 24 of the head, such winding may be of a number of turns (for example, 10 or 20 turns) and the number of layers of tape will alter the playing effects. The tape may be self-adhesive tape, such as ordinary masking tape; or it may be an elastic or rubber-type of tape. If it is used in the embodiment of FIGS. 1 to 3, some stretchable, elastic, type of tape is desirable, so that it will tend to draw the assembly into the groove 19 of the wooden shaft structure. Otherwise, the tape layers 22 may be omitted, and the main body 24 may be secured directly to the elastic tube 21. With any of these constructions, where an adhesive is used, it may desirably be a contact cement or a hot-melt glue. The main yielding body 24 of the playing head may be of a felt-like material, such as wool felt, or layers of flannel.

Thicknesses of various parts, and diameters, tapers, etc. may be varied considerably. As one example: in FIG. 2, the shaft diameter at 18 has been shown as only slightly less than the diameter at 17 (thus exaggerating the apparent depth of the groove 19) but it should be understood that the diameter at 18 may well be less than shown. Similarly: in FIG. 4, the progressive tapering-down of the shaft body, from 17*a* to 16, may differ from the slight taper which is there shown. As another example, the yielding sleeve 21 might be made thicker, so as to readily accommodate different diameters, sizes or contours of the various retaining means. Thus, in these, and other respects, the drawings are to be deemed simply as illustrative and not taken as limitative.

I claim:

1. A musical instrument mallet comprising a hard shaft with an inner handle end and an outer head end, a playing head having a central zone which is so resiliently yieldable and so apertured relative to the maximum diameter of the handle end of said shaft that said head may be slid along said shaft from its handle end toward its head end, a head retainer adjacent the said head end of the shaft and having a dimension so exceeding the aperture of the head that said retainer will hold the playing head against dislodgment outwardly, and head retaining means located inwardly of said retainer, and having a dimension exceeding the aperture of the head but so configured that said resiliently yieldable central zone of said playing head will pass said retaining means, with a moderate pressure, so that the playing head may be forced over said retaining means, and characterized further in that the aperture is of such diameter that after the head is forced over said retaining means the head is retained thereby as against sliding back along the shaft during normal playing operation of the mallet.

2. The construction of claim 1 wherein said playing head as a whole is resiliently yieldable.

3. The construction of claim 1, wherein the said central zone of said playing head comprises an inner resiliently yieldable tube.

4. The construction of claim 3, wherein there is a self-adhesive tape around the tube.

5. The construction of claim 1, wherein a major portion of said playing head is of resiliently yieldable felt-like material.

6. The construction of claim 1, wherein the said head retainer and the head retaining means located inboard of said retainer constitute retaining devices which are integral with the shaft.

7. The construction of claim 6, wherein said shaft and integral retaining devices are of hard wood.

8. The construction of claim 6, wherein the shaft is a metal tube and said devices extend outwardly from the periphery thereof.

9. The construction of claim 1, wherein said retaining means located inwardly of said head retainer is spaced from said head retainer a distance about equal to the axial thickness dimension of the playing head.

10. For a musical instrument mallet, a shaft with a hand-grip-end and a head-end, and longitudinally-spaced-apart rigid retaining devices, adjacent the head-end and adapted to cooperate with a yieldable playing head to prevent dislodgment of such a playing head lengthwise of the shaft under normal playing action, but the innermost of said devices being configured to permit forced passage of such a playing head thereover and wherein said shaft including said hand-grip end, head-end and rigid retaining devices are formed as a single, one-piece integral member.

11. The construction of claim 10, wherein the shaft is for the most part of a diameter less than the diametral dimensions of the retaining devices.

12. The construction of claim 11, wherein said shaft is solid and said diameter tapers, and is narrowest just inboard of the playing head location.

13. The construction of claim 11, wherein said shaft is tubular and of substantially constant diameter throughout most of its length.

14. The construction of claim 10, wherein the shaft is a tube which is abruptly flared at its outer end to form the outermost retaining device.

15. The construction of claim 14, wherein the shaft also has at least one peripheral protuberance spaced inboard from said flare to form the innermost retaining device.

* * * * *